US011980311B1

(12) United States Patent
Liang et al.

(10) Patent No.: US 11,980,311 B1
(45) Date of Patent: May 14, 2024

(54) DETACHABLE SUPPORTING DEVICE

(71) Applicant: Novium Taiwan Inc., Taipei (TW)

(72) Inventors: Kuo-Hung Liang, Chiayi (TW); Ming-Wei Kuo, Taipei (TW)

(73) Assignee: Novium Taiwan Inc., Taipei (TW)

( * ) Notice: Subject to any disclaimer, the term of this patent is extended or adjusted under 35 U.S.C. 154(b) by 0 days.

(21) Appl. No.: 18/383,895

(22) Filed: Oct. 25, 2023

(30) Foreign Application Priority Data

Dec. 15, 2022 (TW) ..... 111148161

(51) Int. Cl.
*A47G 35/00* (2006.01)

(52) U.S. Cl.
CPC ..... *A47G 35/00* (2013.01); *A47G 2200/106* (2013.01)

(58) Field of Classification Search
CPC ..... A47G 35/00; A47G 29/00; A47G 29/08; A47G 2200/10; A47G 2200/106; F16M 11/041; H01F 7/02
USPC ..... 248/346.03, 683, 206.5, 309.4
See application file for complete search history.

(56) References Cited

U.S. PATENT DOCUMENTS 2,510,634 A * 6/1950 Hull ..... B43M 99/004 211/DIG. 1
2,693,788 A * 11/1954 Spatz ..... B43M 99/004 D19/75
3,162,313 A * 12/1964 Aimes ..... B43K 23/002 211/69.8
3,387,341 A * 6/1968 Mates ..... B43K 23/001 248/205.2
3,729,158 A * 4/1973 Nagy ..... B44D 3/123 248/231.71
4,643,604 A * 2/1987 Enrico ..... B43K 29/00 211/DIG. 1
4,865,285 A * 9/1989 Gaggianese ..... B43M 99/004 211/DIG. 1
4,912,727 A * 3/1990 Schubert ..... A47B 88/49 312/334.36
4,976,385 A * 12/1990 Matsumoto ..... B60N 3/103 224/567
5,842,721 A * 12/1998 Kawabe ..... G09F 1/10 281/DIG. 1

(Continued)

FOREIGN PATENT DOCUMENTS

TW M631674 U 9/2022

*Primary Examiner* — Christopher Garft
*Assistant Examiner* — Michael McDuffie
(74) *Attorney, Agent, or Firm* — Winston Hsu

(57) ABSTRACT

A detachable supporting device includes a base and a magnetic force providing module. The base has a body portion and a stretching portion. The magnetic force providing module has a first magnetic component, a first magnetic assembly and a second magnetic assembly. The first magnetic component is disposed on the stretching portion. The first magnetic assembly includes a second magnetic component and a third magnetic component. Two poles of the second magnetic component respectively face an upper surface and a lower surface of the body portion. A pole of the third magnetic component faces the second magnetic component. The second magnetic assembly includes a fourth magnetic component and a fifth magnetic component. Two poles of the fourth magnetic component respectively face the upper surface and the lower surface. A pole of the fifth magnetic component faces the fourth magnetic component.

7 Claims, 6 Drawing Sheets

(56) References Cited

U.S. PATENT DOCUMENTS

| | | | | |
|---|---|---|---|---|
| 7,348,691 | B2 * | 3/2008 | Davis | H02N 15/00 310/90.5 |
| 8,258,663 | B2 * | 9/2012 | Smoot | H02N 15/00 310/90.5 |
| 10,532,601 | B2 * | 1/2020 | Davies-Smith | B43K 25/00 |
| 11,375,789 | B2 * | 7/2022 | Weber | F16B 1/00 |
| 2008/0308702 | A1 * | 12/2008 | Beyer, Jr. | B42D 5/046 248/475.1 |
| 2009/0035050 | A1 | 2/2009 | Ramos | |
| 2018/0029404 | A1 * | 2/2018 | Koga | B43K 23/001 |
| 2023/0094251 | A1 * | 3/2023 | Liang | H01F 7/02 335/216 |

* cited by examiner

DETACHABLE SUPPORTING DEVICE

BACKGROUND OF THE INVENTION

1. Field of the Invention

The present invention relates to a detachable supporting device, and more particularly, to a detachable supporting device of stably holding a target component.

2. Description of the Prior Art

A conventional multi-tool, such as a letter opener, a ruler and so on, is generally placed in the storage device, such as the pen holder or the pencil case, and the multi-tool is taken from the pen holder or the pencil case when the user wants to use it. There may be a lot of pens placed in the pen holder, which seems to be messy. There is a pen suspending and supporting device that utilizes the magnetic attraction force to position the pen tip on the base, and further utilizes the magnetic repulsion force to upwardly suspend the pen body, so that the rear section of the pen can be suspended above the base. Therefore, design of a suspending and supporting device applied to the multi-tool can improve aesthetics of the storage device.

SUMMARY OF THE INVENTION

The present invention provides a detachable supporting device of stably holding a target component for solving above drawbacks.

According to the claimed invention, a detachable supporting device includes a base and a magnetic force providing module. The base has a body portion and a stretching portion. The body portion has a first side and a second side opposite to each other, and the stretching portion is outwardly stretched from a side of the body portion. The magnetic force providing module is assembled with the base. The magnetic force providing module includes a first magnetic component, a first magnetic assembly and a second magnetic assembly. The first magnetic component is disposed on an end of the stretching portion opposite to the body portion. The first magnetic assembly is disposed on the first side. The first magnetic assembly includes a second magnetic component and a third magnetic component. Two magnetic poles of the second magnetic component respectively face toward an upper surface and a lower surface of the body portion. The third magnetic component is disposed adjacent to the second magnetic component, and a magnetic pole of the third magnetic component faces toward the second magnetic component. The second magnetic assembly is disposed on the second side. The second magnetic assembly includes a fourth magnetic component and a fifth magnetic component. Two magnetic poles of the fourth magnetic component respectively face toward the upper surface and the lower surface. The fifth magnetic component is disposed adjacent to the fourth magnetic component, and a magnetic pole of the fifth magnetic component faces toward the fourth magnetic component.

According to the claimed invention, the detachable supporting device further includes a target component detachably positioned on the base. The target component includes a main body, a magnetizable unit and a magnetic unit. The magnetizable unit is disposed on a front end of the main body to detachably abut against a positioning area of the base where on the first magnetic component is disposed. The magnetic unit is disposed on a middle area of the main body to functionalize with the first magnetic assembly and the second magnetic assembly.

The detachable supporting device of the present invention can utilize the base to hold the target component; the magnetic force providing module of the base can utilize the first magnetic component to attract the magnetizable unit of the target component, and further utilize the first magnetic assembly and the second magnetic assembly to hold the magnetic unit of the target component in a contactless manner, so that the main body of the target component can obliquely stand on the base. The target component can be a multi-tool, such as a letter opener, a ruler and so on, and can be suspended via single-point support; if the target component is a pen-shaped object with a sharp point or any similar external object, the target component can be rotated with its long axis as the rotation axis, and variation of the rotation axis can depend on the shape of the target component and matching of the magnetic component. Each magnetic component of the magnetic force providing module can be preferably hid inside the base, and set one the level the same as or similar to the level where on other magnetic components are disposed; the magnetic component may be exposed out of the base but still located on the same or similar level. The first magnetic assembly (or the second magnetic assembly) can dispose a plurality of magnetic components in a specific arrangement, and the range of magnetic fields generated by the plurality of magnetic components can provide the uniform and stable magnetic repulsion force, so as to stably hold the target component without falling out of the base due to accidental collision or non-contact force.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
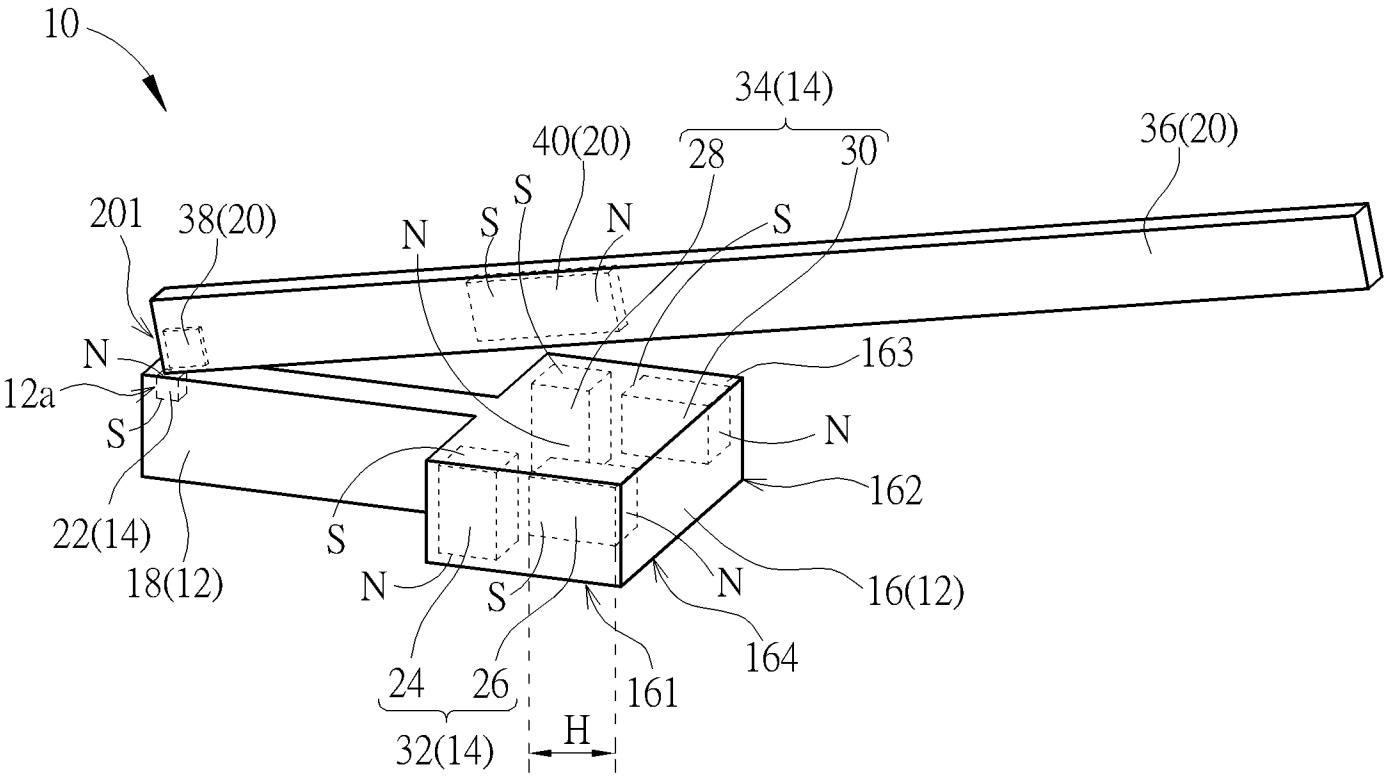
FIG. 1 is a diagram of a detachable supporting device according to a first embodiment of the present invention.

Please refer to FIG. 1. FIG. 1 is a diagram of a detachable supporting device 10 according to a first embodiment of the present invention. The detachable supporting device 10 can include a base 12 and a magnetic force providing module 14. The base 12 can include a body portion 16 and a stretching portion 18. The stretching portion 18 can be outwardly stretched from a side of the body portion 16. Other sides of the body portion 16 that are different from the stretching portion 18 can be defined as a first side 161 and a second side 162. The magnetic force providing module 14 can be assembled with the base 12 to provide a magnetic attraction force and a magnetic repulsion force. In the possible embodiment, the detachable supporting device 10 can further include a target component 20. A front end 201 of the target component 20 can be detachably positioned on the base 12 via the magnetic attraction force provided by the magnetic force providing module 14. A rear end of the target component 20 can be suspend above the base 12 via the magnetic repulsion force provided by the magnetic force providing module 14.

The magnetic force providing module 14 can include a first magnetic component 22, a second magnetic component 24, a third magnetic component 26, a fourth magnetic component 28 and a fifth magnetic component 30. The first magnetic component 22 can be disposed on an end of the stretching portion 18 opposite the body portion 16. The second magnetic component 24 and the third magnetic component 26 can be defined as a first magnetic assembly 32 disposed on the first side 161 of the body portion 16. The fourth magnetic component 28 and the fifth magnetic component 30 can be defined as a second magnetic assembly 34 disposed on the second side 162 of the body portion 16. The first magnetic component 22 can be used to attract the front end 201 of the target component 20. The first magnetic assembly 32 and the second magnetic assembly 34 can be respectively disposed on two opposite lateral sides of the body portion 16, and used to suspend the rear end of the target component 20 above the base 12.

The target component 20 can include a main body 36, a magnetizable unit 38 and a magnetic unit 40. A shape of the main body 36 can depend on a type of the target component 20. For example, if the target component 20 is a letter opener, the main body 36 can be designed as a long blade; variation of the main body 36 depends on a design demand, and a detailed description is omitted herein for simplicity. The magnetizable unit 38 can be disposed on the front end of the main body 36, and detachably abut against a positioning area 12*a* of the base 12 where on the first magnetic component 22 is disposed. The magnetizable unit 38 can be made by stainless steel, ferromagnetic material, or other materials with similar property, or can be replaced by the magnet. The magnetic unit 40 can be disposed on a middle area of the main body 36, and used to functionalize with the first magnetic assembly 32 and the second magnetic assembly 34. It should be mentioned that the middle area is not limited to be a center place on the main body 36, and may be an area adjacent to the middle of the main body 36 but further close to the front end or the rear end, or may be directly disposed on the rear end of the main body 36.

As shown in FIG. 1, the first magnetic pole S of the first magnetic component 22 can face toward the bottom of the stretching portion 18, and the second magnetic pole N of the first magnetic component 22 can face toward the top of the stretching portion 18. The first magnetic pole S of the second magnetic component 24 can face towards an upper surface 163 of the body portion 16, and the second magnetic pole N of the second magnetic component 24 can face towards a lower surface 164 of the body portion 16. The third magnetic component 26 can be disposed on position adjacent to the second magnetic component 24. The first magnetic pole S of the third magnetic component 26 can face towards the second magnetic component 24, and the second magnetic pole N of the third magnetic component 26 can face towards other orientation that is opposite to the second magnetic component 24. Accordingly, the fifth magnetic component 30 can be disposed on position adjacent to the fourth magnetic component 28. The first magnetic pole S of the fourth magnetic component 28 can face towards the upper surface 163 of the body portion 16, and the second magnetic pole N of the fourth magnetic component 28 can face towards the lower surface 164 of the body portion 16. The first magnetic pole S of the fifth magnetic component 30 can face towards the fourth magnetic component 28, and the second magnetic pole N of the fifth magnetic component 30 can face towards other orientation that is opposite to the fourth magnetic component 28.

In addition, the first magnetic pole S of the magnetic unit 40 can correspond to the first magnetic pole S of the second magnetic component 24, and the second magnetic pole N of the magnetic unit 40 can correspond to the second magnetic pole N of the third magnetic component 26. If the magnetizable unit 38 of the target component 20 is replaced by another magnetic unit, the first magnetic pole S of the replaced magnetic unit can face towards the second magnetic pole N of the first magnetic component 22 to provide the magnetic attraction force. In the present invention, features of the first magnetic pole S and the second magnetic pole N are not limited to the foresaid embodiment; for example, the first magnetic pole may be set as the N pole, and the second magnetic pole may be accordingly changed to the S pole. Setting and variation of the first magnetic pole S and the second magnetic pole N can depend on an actual demand, and other possible application can be omitted herein.

Figure 2:
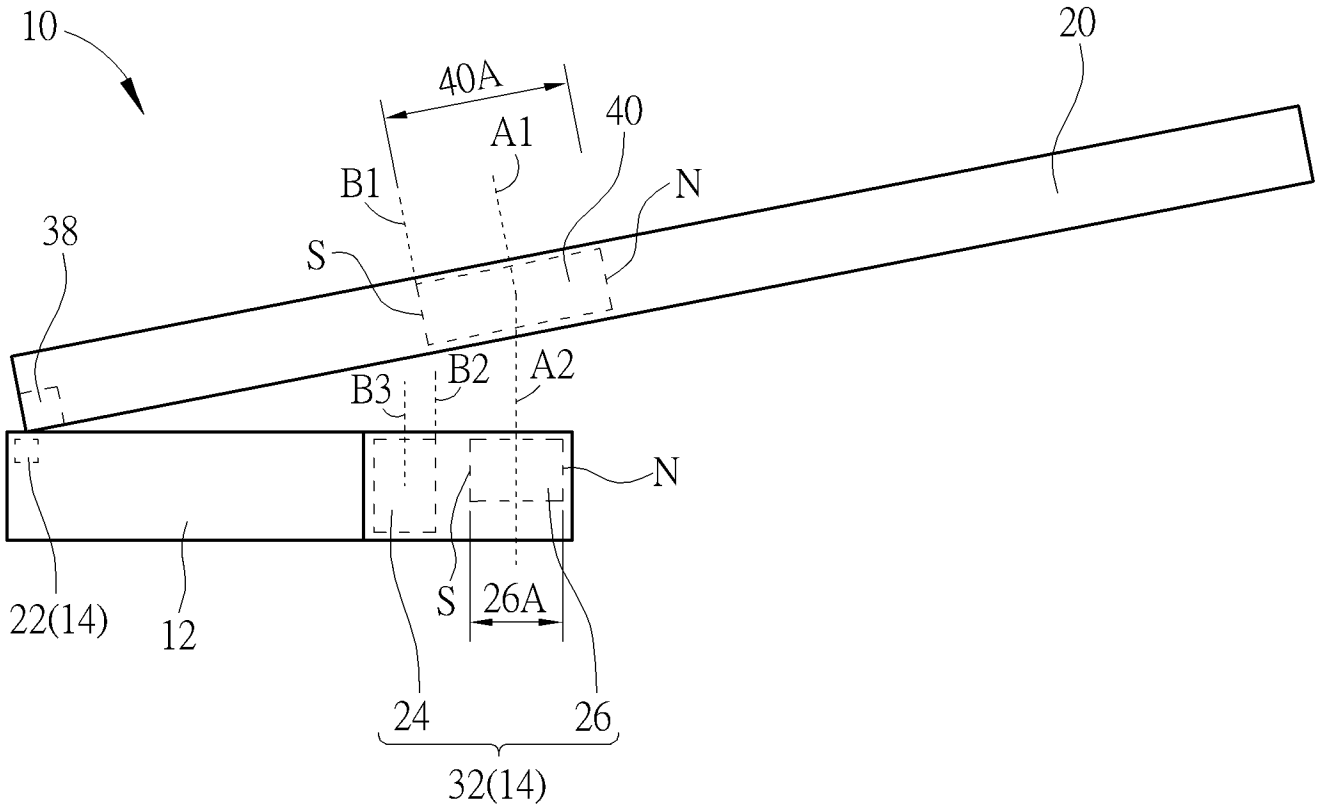
FIG. 2 and FIG. 3 are lateral views of a part of the detachable supporting device in different types according to the first embodiment of the present invention.
Figure 3:
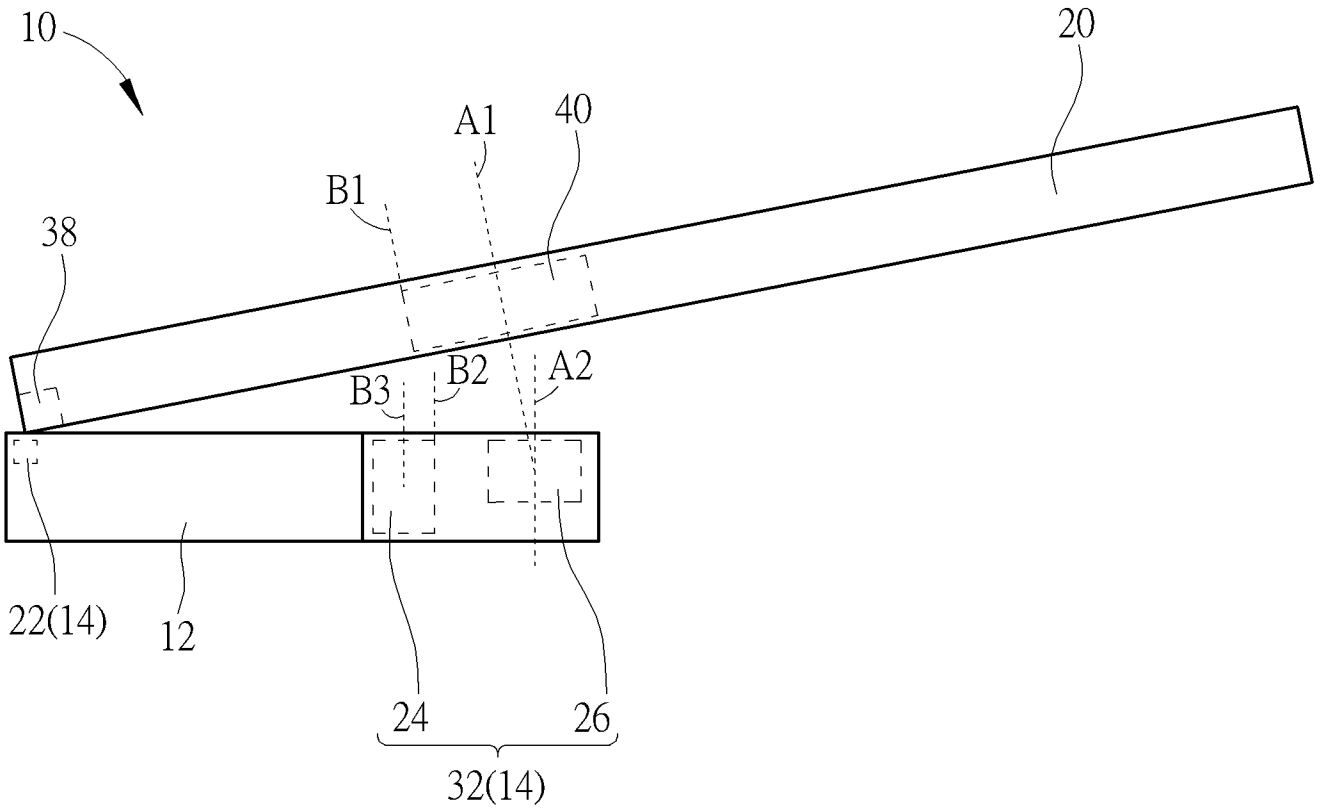

Please refer to FIG. 2 and FIG. 3. FIG. 2 and FIG. 3 are lateral views of a part of the detachable supporting device 10 in different types according to the first embodiment of the present invention. When the front end 201 of the target component 20 detachably abuts against the positioning area 12*a* of the base 12, an included angle of the main body 36 of the target component 20 relative to the base 12 can be decided by the magnetic repulsion force of the first magnetic assembly 32 and the second magnetic assembly 34 applied to the magnetic unit 40. An actual value of the foresaid included angle is not constant, and can be varied in accordance with the design demand of the magnetic force providing module 14. Therefore, the present invention can further define that a central axis A1 of the magnetic unit 40 can align with or point towards a central axis A2 of the third magnetic component 26. For example, a virtual extension line of the central axis A2 can pass through a middle point of the magnetic unit 40, as shown in FIG. 2; or the virtual extension line of the central axis A1 can pass through the middle point of the third magnetic component 26, as shown in FIG. 3. Besides, misalignment of the central axis A1 and the central axis A2 may be defined as being smaller than one third and one fourth of a length of one of the third magnetic component 26 and the magnetic unit 40 which has the minimal size (such as the length H of the third magnetic component 26 shown in FIG. 1), which means an interval between a point where the virtual extension line of the central axis A1 passing through the third magnetic component 26 and a middle point of the third magnetic component 26 can be set between one third and one fourth of the length of one of the third magnetic component 26 and the magnetic unit 40 which has the minimal size, as shown in FIG. 2; or an interval between a point where the virtual extension line of the central axis A2 passing through magnetic unit 40 and the middle point of the magnetic unit 40 can be set between one third and one fourth of the length of one of the third magnetic component 26 and the magnetic unit 40 which has the minimal size, as shown in FIG. 3. Further, as shown in FIG. 1 and FIG. 2, the central axis A1 can be defined as a division axle of a long axis 40A of the magnetic unit 40, which means two distances from the central axis A1 (or the division axle) respectively relative to outermost edges of the first magnetic pole S and the second magnetic pole N on two opposite ends of the magnetic unit 40 are the same; the central axis A2 can be defined as a division axle of a long axis 26A of the third magnetic component 26, which means two distances from the central axis A2 (or the division axle) respectively relative to outermost edges of the first magnetic pole S and the second magnetic pole N on two opposite ends of the third magnetic component 26 are the same.

Moreover, when the front end 201 of the target component 20 detachably abuts against the positioning area 12*a* of the base 12, a projection point of a bottom end of the boundary B1 of the magnetic unit 40 on the base 12 can be located on place inside an extension range between the boundary B2 and the central axis B3 of the second magnetic component 24. That is to say, as shown in FIG. 2, the left lateral side of the magnetic unit 40 may be located above and between the boundary B2 and the central axis B3 of the second magnetic component 24, and the middle point of the magnetic unit 40 may be located above the middle point of the third magnetic component 26. Lengths and relative position of the magnetic unit 40, the second magnetic component 24 and the third magnetic component 26 are not limited to the foresaid embodiment, and depend on the design demand. As shown in FIG. 1 and FIG. 2, the boundary of the magnetic unit 40 may be interpreted as edges of two sides of the magnetic unit 40; for example, the boundary B1 can be the edge where on the S pole is disposed. The boundary of the second magnetic component 24 may be interpreted as edges of two sides of the second magnetic component 24; for example, the boundary B2 can be the edge close to the third magnetic component 26. The central axis B3 may be an axis on a short axis of the second magnetic component 24, which means two distances from the central axis B3 relative to the left end and the right end of a short axis of the magnetic unit 40 are the same.

Figure 4:
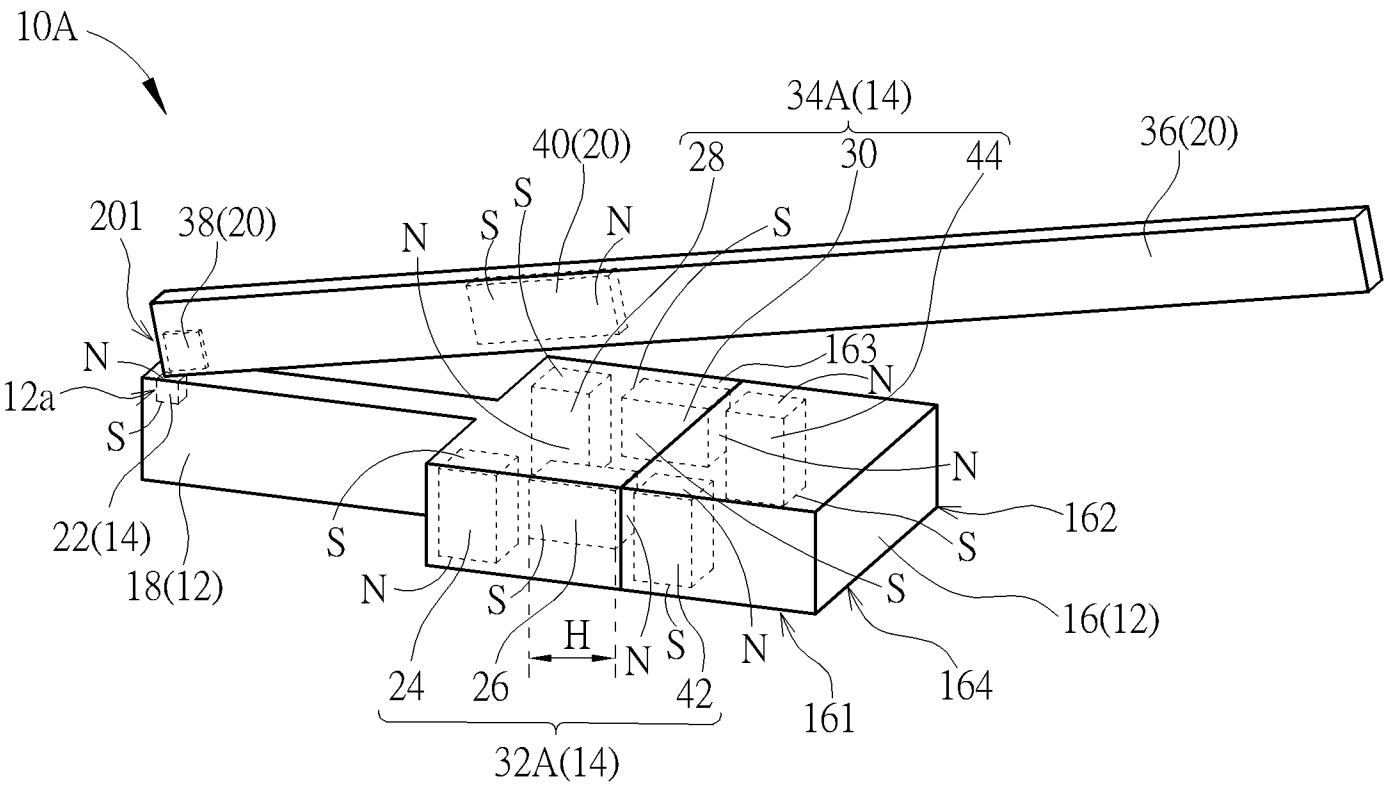
FIG. 4 is a diagram of the detachable supporting device according to a second embodiment of the present invention.

Please refer to FIG. 4. FIG. 4 is a diagram of the detachable supporting device 10A according to a second embodiment of the present invention. In the second embodiment, elements having the same numerals as ones of the first embodiment have the same structures and functions, and the detailed description is omitted herein for simplicity. The first magnetic assembly 32A of the detachable supporting device 10A can further include a sixth magnetic component 42 disposed on a side of the third magnetic component 26 opposite to the second magnetic component 24. The second magnetic assembly 34A can further include a seventh magnetic component 44 disposed on a side of the fifth magnetic component 30 opposite to the fourth magnetic component 28. The first magnetic pole S and the second magnetic pole N of the sixth magnetic component 42 can respectively face towards the lower surface 164 and the upper surface 163 of the body portion 16. The first magnetic pole S and the second magnetic pole N of the seventh magnetic component 44 can respectively face towards the lower surface 164 and the upper surface 163 of the body portion 16.

Figure 5:
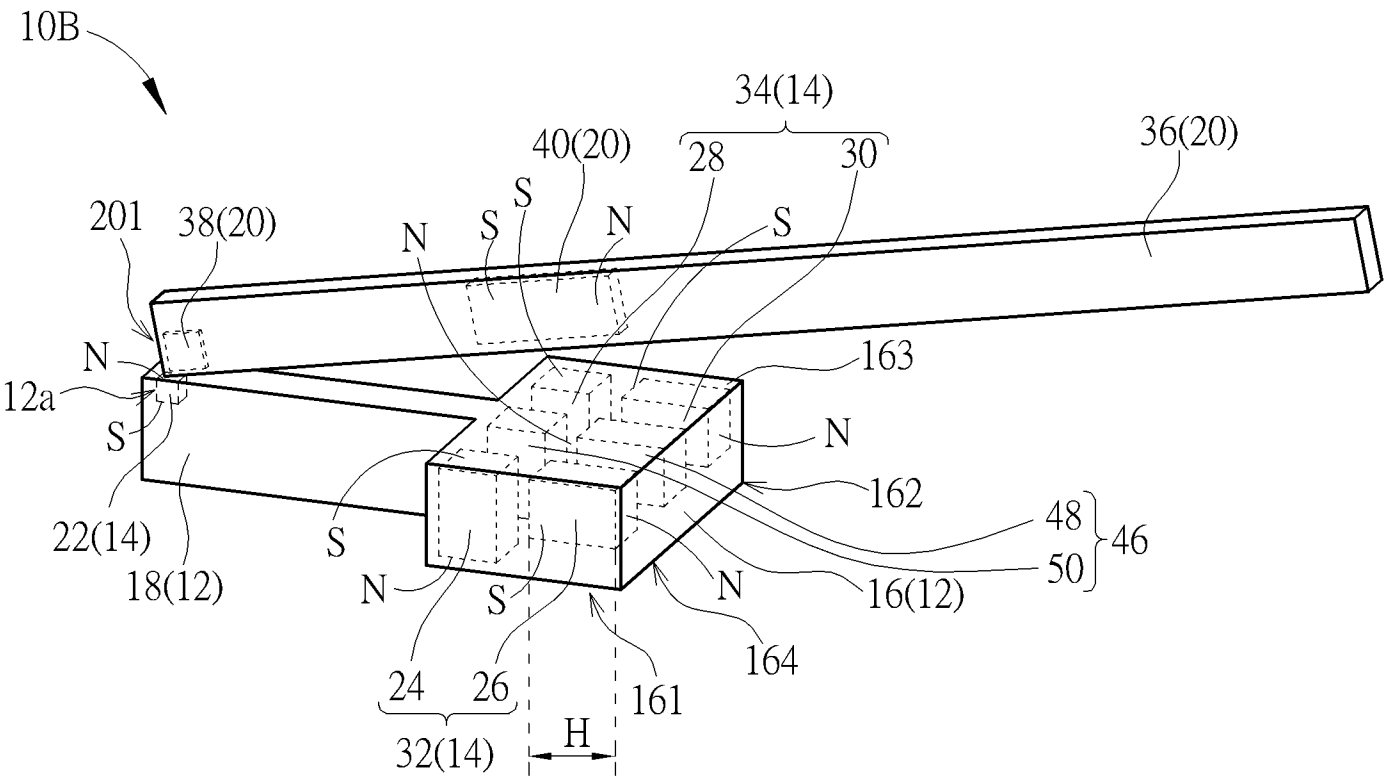
FIG. 5 is a diagram of the detachable supporting device according to a third embodiment of the present invention.

Please refer to FIG. 5. FIG. 5 is a diagram of the detachable supporting device 10B according to a third embodiment of the present invention. In the third embodiment, elements having the same numerals as ones of the foresaid embodiment have the same structures and functions, and the detailed description is omitted herein for simplicity. The magnetic force providing module 14 of the detachable supporting device 10B can further include a third magnetic assembly 46 disposed between the first magnetic assembly 32 and the second magnetic assembly 34. The third magnetic assembly 46 can include at least two magnetic components 48 and 50, and pole arrangement of the magnetic components 48 and 50 can be the same as pole arrangement of the first magnetic assembly 32 or the second magnetic assembly 34; besides, the third magnetic assembly 46 may include three magnetic components (which are not shown in the figures), and pole arrangement of the three magnetic components can be the same as or similar to the pole arrangement of the first magnetic assembly 32A or the second magnetic assembly 34A.

Figure 6:
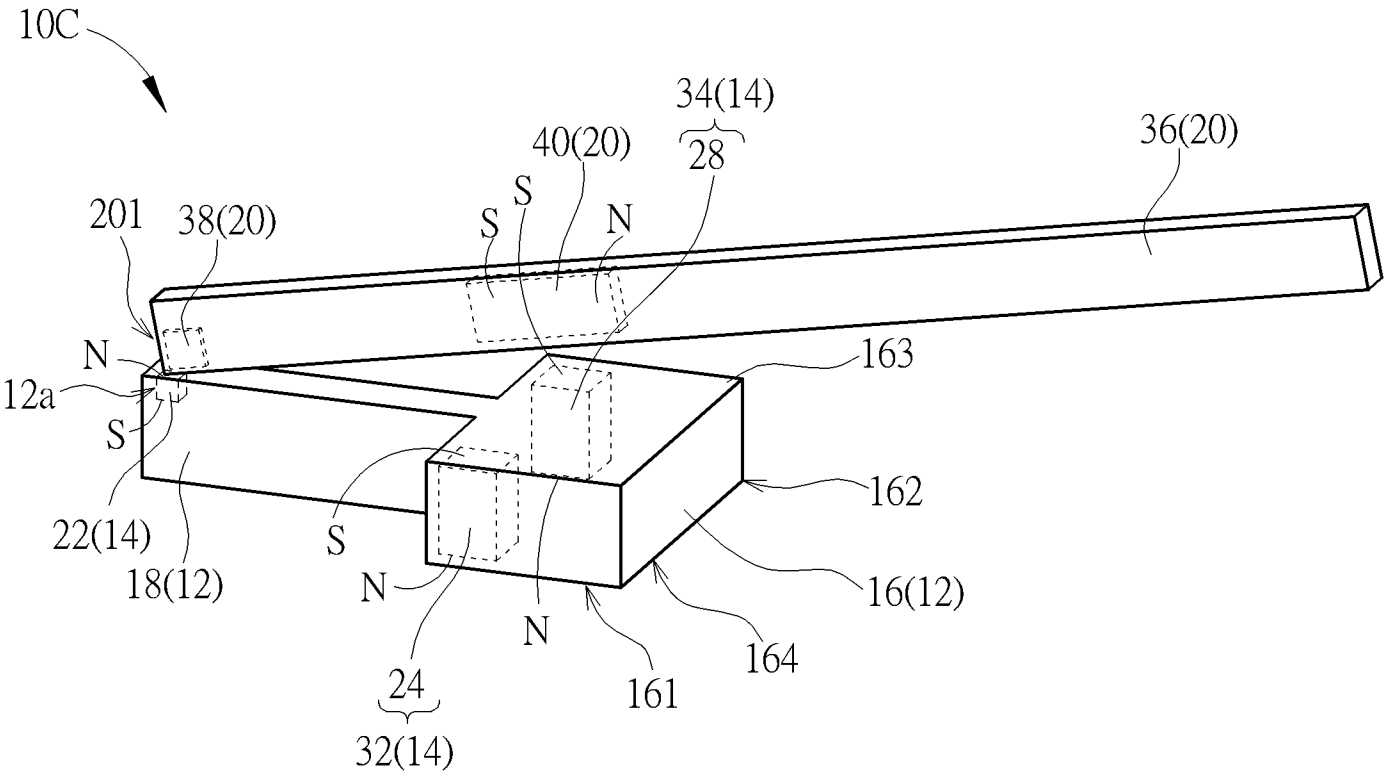
FIG. 6 is a diagram of the detachable supporting device according to a fourth embodiment of the present invention.

Please refer to FIG. 6. FIG. 6 is a diagram of the detachable supporting device 10C according to a fourth embodiment of the present invention. In the fourth embodiment, elements having the same numerals as ones of the foresaid embodiment have the same structures and functions, and the detailed description is omitted herein for simplicity. The magnetic force providing module 14 of the detachable supporting device 10C can only include the first magnetic component 22, the second magnetic component 24 and the fourth magnetic component 28. Structural design of the target component 20 can be the same as ones of the foresaid embodiment. If the case of the target component 20 is made by lightweight material, and the magnetic force providing module 14 of the detachable supporting device 10C does not need to provide the greater magnetic repulsion force, configuration design of the magnetic components in the fourth embodiment can be applicable.

In conclusion, the detachable supporting device of the present invention can utilize the base to hold the target component; the magnetic force providing module of the base can utilize the first magnetic component to attract the magnetizable unit of the target component, and further utilize the first magnetic assembly and the second magnetic assembly to hold the magnetic unit of the target component in a contactless manner, so that the main body of the target component can obliquely stand on the base. The target component can be a multi-tool, such as a letter opener, a ruler and so on, and can be suspended via single-point support; if the target component is a pen-shaped object with a sharp point or any similar external object, the target component can be rotated with its long axis as the rotation axis, and variation of the rotation axis can depend on the shape of the target component and matching of the magnetic component. Each magnetic component of the magnetic force providing module can be preferably hid inside the base, and set one the level the same as or similar to the level where on other magnetic components are disposed; the magnetic component may be exposed out of the base but still located on the same or similar level. The first magnetic assembly (or the second magnetic assembly) can dispose a plurality of magnetic components in a specific arrangement, and the range of magnetic fields generated by the plurality of magnetic components can provide the uniform and stable magnetic repulsion force, so as to stably hold the target component without falling out of the base due to accidental collision or non-contact force.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A detachable supporting device comprising:

a base having a body portion and a stretching portion, the body portion having a first side and a second side opposite to each other, the stretching portion being outwardly stretched from a side of the body portion;

a magnetic force providing module assembled with the base, the magnetic force providing module comprising:

a first magnetic component disposed on an end of the stretching portion opposite to the body portion;

a first magnetic assembly disposed on the first side, the first magnetic assembly comprising:

a second magnetic component, two magnetic poles of the second magnetic component respectively facing toward an upper surface and a lower surface of the body portion; and a third magnetic component adjacent to the second magnetic component, a magnetic pole of the third magnetic component facing toward the second magnetic component; and a second magnetic assembly disposed on the second side, the second magnetic assembly comprising:

a fourth magnetic component, two magnetic poles of the fourth magnetic component respectively facing toward the upper surface and the lower surface; and a fifth magnetic component adjacent to the fourth magnetic component, a magnetic pole of the fifth magnetic component facing toward the fourth magnetic component; and a target component detachably positioned on the base, the target component comprising a main body, a magnetizable unit and a magnetic unit, the magnetizable unit being disposed on a front end of the main body to detachably abut against a positioning area of the base where on the first magnetic component is disposed, the magnetic unit being disposed on a middle area of the main body to functionalize with the first magnetic assembly and the second magnetic assembly.

2. The detachable supporting device of claim 1, wherein the second magnetic component and the third magnetic component respectively has a first magnetic pole and a second magnetic pole, the first magnetic pole of the second magnetic component faces toward the upper surface, the first magnetic pole of the third magnetic component faces toward the second magnetic component.

3. The detachable supporting device of claim 2, wherein the magnetic unit has a first magnetic pole and a second magnetic pole, the first magnetic pole of the magnetic unit faces toward the first magnetic pole of the second magnetic component, the second magnetic pole of the magnetic unit faces toward the second magnetic pole of the third magnetic component.

4. The detachable supporting device of claim 1, wherein when the magnetizable unit abuts against the positioning area, a central axis of the magnetic unit aligns with a central axis of the third magnetic component, and misalignment of the foresaid two central axes is smaller than one tenth of a length of the third magnetic component; the central axis of the magnetic unit is interpreted as two distances from the central axis respectively to a first magnetic pole and a second magnetic pole on two opposite ends of the magnetic unit are the same, the central axis of the third magnetic component is interpreted as two distances from the central axis respectively to a first magnetic pole and a second magnetic pole on two opposite ends of the third magnetic component are the same.

5. The detachable supporting device of claim 1, wherein when the magnetizable unit abuts against the positioning area, a projection point of a boundary of the magnetic unit on the base is set between an extension range between a boundary and a central axis of the second magnetic component.

6. The detachable supporting device of claim 1, wherein the magnetic force providing module is located on somewhere the same as or similar to a level of the base and hid inside the base, or is exposed out of the base.

7. The detachable supporting device of claim 1, wherein the magnetizable unit is replaced by a magnet.

* * * * *